United States Patent [19]

Namdari

[11] 4,431,118

[45] Feb. 14, 1984

[54] ATTACK REPELLENT DEVICE

[76] Inventor: Bahram Namdari, P.O. Box 17366, Milwaukee, Wis. 53217

[21] Appl. No.: 248,031

[22] Filed: Mar. 26, 1981

[51] Int. Cl.[3] ..... B67D 5/32; B67B 7/24

[52] U.S. Cl. ..... 222/39; 222/5; 222/78; 222/83; 222/153; 222/541

[58] Field of Search ..... 222/3, 5, 78, 80, 81, 222/87, 153, 175, 541, 83.5, 83, 82, 39; 42/16

[56] References Cited

U.S. PATENT DOCUMENTS

| | | | |
|---|---|---|---|
| 3,930,597 | 1/1976 | Fegley | 222/83.5 |
| 4,058,237 | 11/1977 | Luke | 222/78 |
| 4,061,249 | 12/1977 | Smith | 222/78 |
| 4,135,645 | 1/1979 | Kimmell | 222/83 |
| 4,241,850 | 12/1980 | Speer | 222/39 |

*Primary Examiner*—Joseph J. Rola
*Assistant Examiner*—Michael S. Huppert
*Attorney, Agent, or Firm*—Andrus, Sceales, Starke & Sawall

[57] ABSTRACT

An attack repellant device to be worn externally by a user houses a replaceably container of repellent fluid (malodorous or irritating) which is selectively releasable to repel, discourage or subsequently identify an attacher or assailant. The container includes a portion which is breakable to release the fluid through a nozzle (or through a screen) by a pair of manually actuatable pushbutton fluid release members which can be depressed to break the container portion only after four manually actuatable pushbutton resettable trigger members are first depressed. The fluid release members mechanically interlock with each other and each fluid release member also interlocks with one pair of trigger members. The nozzle includes an optionally usable manually operable valve to prevent or terminate fluid release even after all pushbutton members are actuated. The device includes an electric safety alarm system to warn the wearer if any one of the trigger members has been unintentionally actuated.

9 Claims, 16 Drawing Figures

FIG. 16
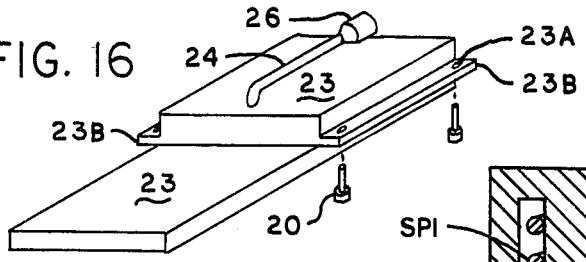
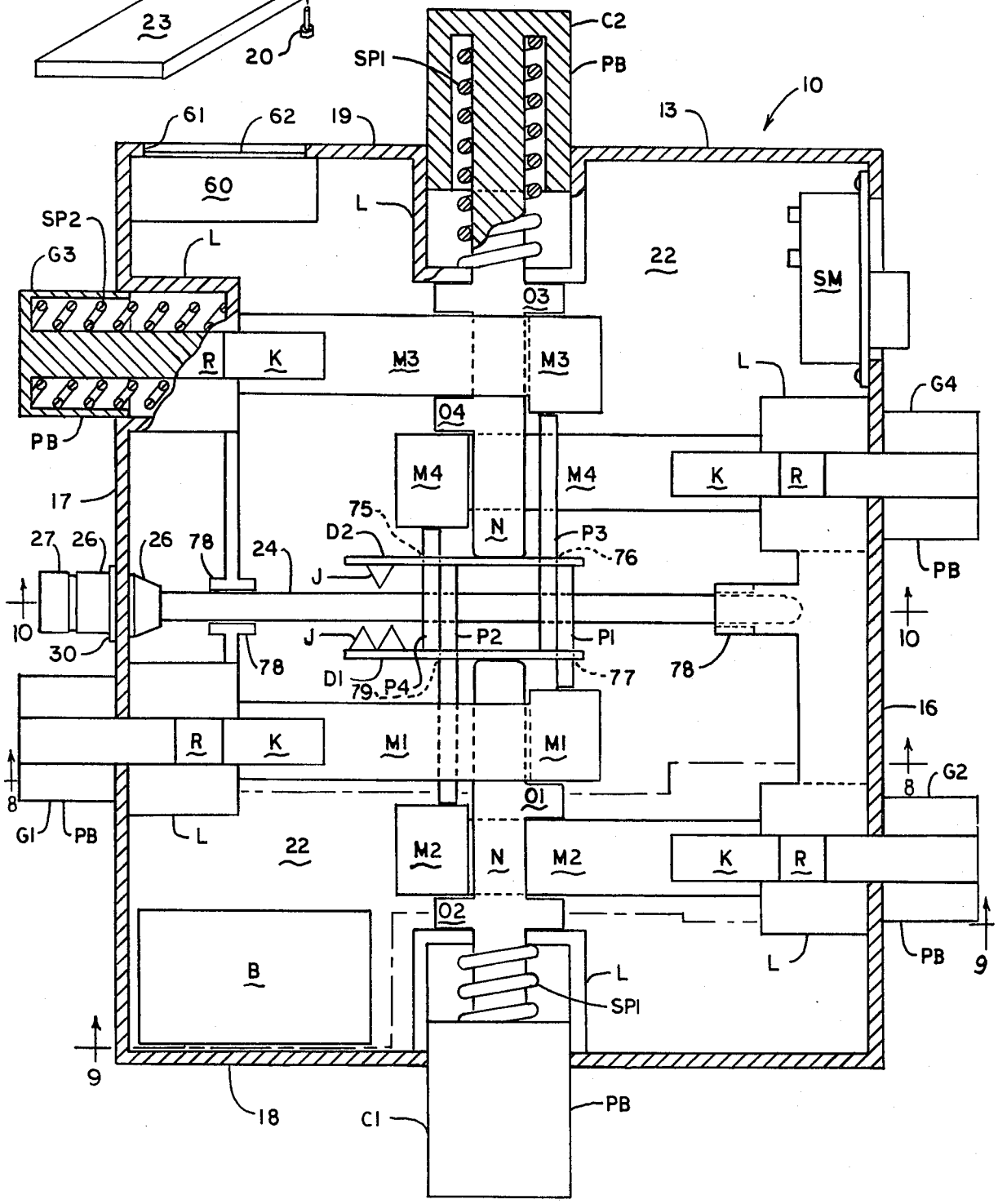
FIG. 7

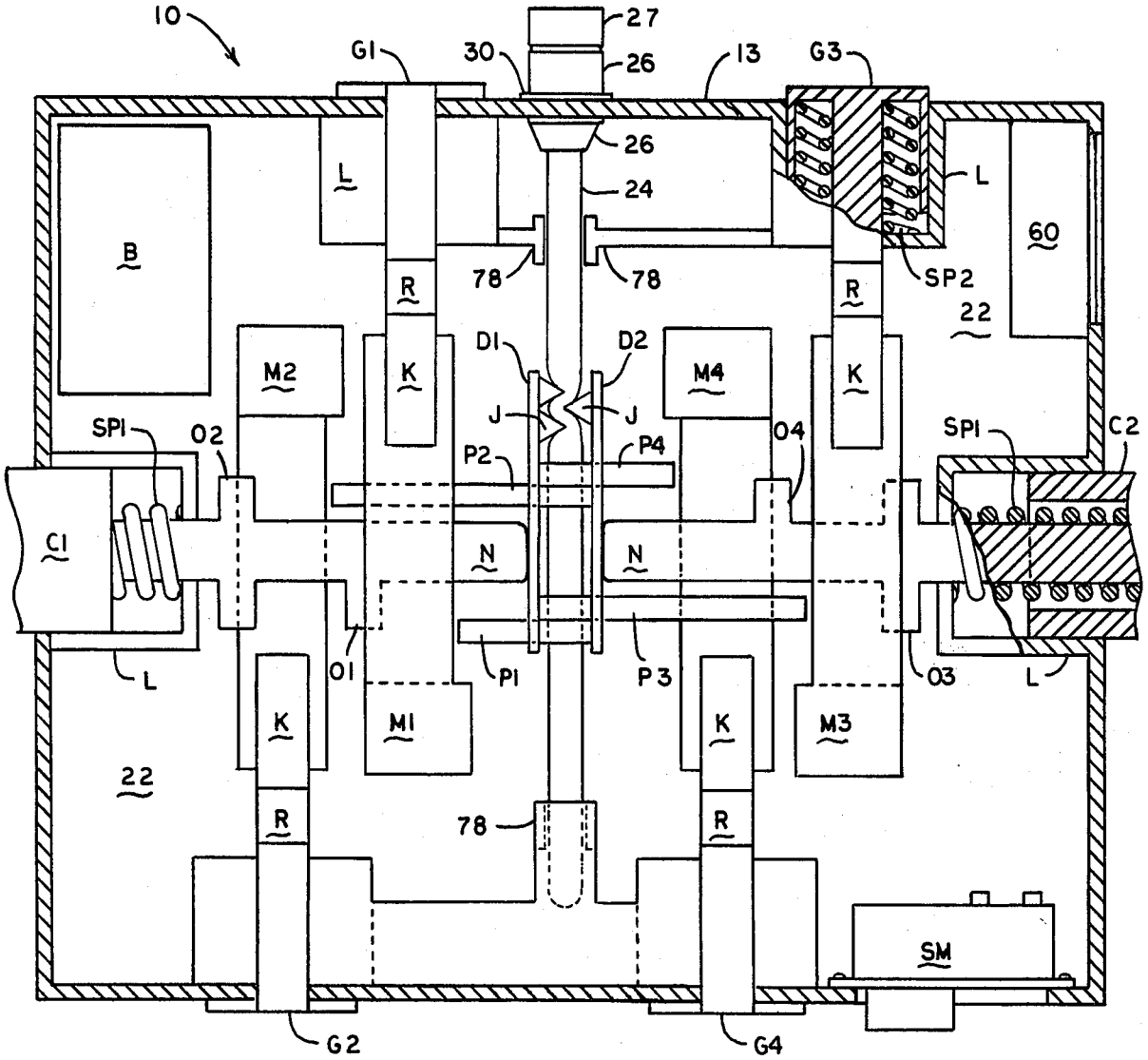
FIG. 12
FIG. 13
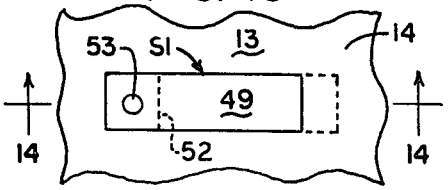
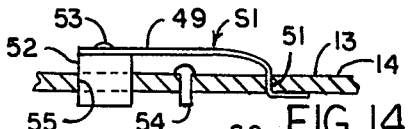
FIG. 14
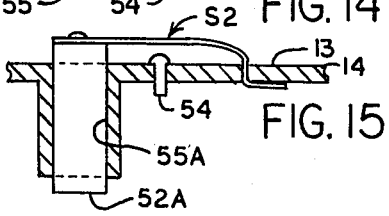
FIG. 15
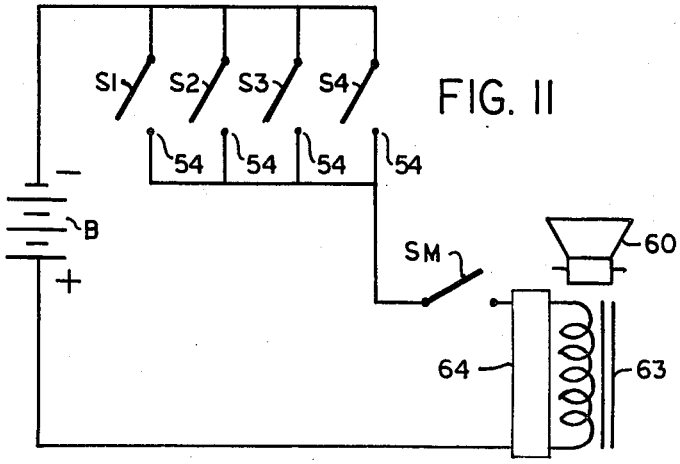
FIG. 11

ATTACK REPELLENT DEVICE

BACKGROUND OF THE INVENTION

1. Field of Use

This invention relates generally to attack repellent devices to be worn by users and which contain a repellent fluid which is selectively releasable in spray form by the user to repel, discourage or subsequently identify an attacker or assailant.

2. Description of the Prior Art

The prior art contains numerous examples of devices or apparatus of the aforesaid character and the following U.S. Patents illustrate the state of the art.

U.S. Pat. No. 1,885,180 discloses burglar repelling apparatus including a reservoir for repellent fluid worn on the body of the user, a movable fluid outlet or nozzle worn on the user's wrist, and a release trigger near the user's hand.

U.S. Pat. Nos. 3,830,404; 2,078,326; and 1,923,979 each disclose protective devices to be carried in the user's pocket or purse and having a trigger actuable to release a repellent fluid through a nozzle which is aimed at an assailant.

U.S. Pat. No. 3,952,917 discloses a device in the form of a piece of jewelry to be worn by the user and containing a supply of releasable fluid.

U.S. Pat. Nos. 4,135,645; 4,061,249; 4,034,982, and 3,353,749 each disclose a ring to be worn by a user and containing a releasable repellent fluid.

SUMMARY OF THE PRESENT INVENTION

An attack repellent device in accordance with the present invention is intended to be worn externally by the user, as by being mounted on a strong, not easily broken or detached bracelet, necklace, belt buckle or piece of jewelry, so that it is immediately available for use and protection at the time of a sudden attack by a rapist, thief or other assailant and thereby eliminates the need for the user to reach into purse or pocket in search for some type of defensive weapon.

The device houses a replaceable container, such as a glass vial or small cannister, of pressurized repellent fluid, such as a gas or liquid having an obnoxious clinging odor or irritating properties (i.e., skunk scent, tear gas, etc.), which fluid is selectively releasable in spray form to repel, discourage or subsequently identify the assailant. Tear gas, vomit-inducing chemicals, eye irritants, offensive scents such as skunt-scent, or any combination there of may be used as the fluid. The container is breakable, or includes a portion which is breakable, to release the fluid through a screen or nozzle on the device which can be aimed or pointed at the assailant. Since the wearer would usually defend herself or himself by grabbing and touching the assailant particularly around the face and neck, this would give the assailant a strong spray of the scent which would discourage the attack and, hopefully, cause him to run away. Since the scent will remain with the assailant for a while, he can be identified easily if he is followed by the police or other people for arrest.

Breaking is accomplished by manual actuation (depression) of a pair of fluid release members only after a plurality of (four) resettable trigger members are first manually actuated (as by being depressed). The trigger members serve as a hazard or accident prevention system which make it almost impossible for container breakage and fluid release to occur accidentally or unintentionally at an undesirable time or location, thereby causing trouble and embarrasment. Only after the plurality of the trigger members are each actuated can the fluid be released by actuation of the fluid release members which actually break the container. Actuation of both sets of members can be done in a matter of a few seconds.

The nozzle includes an optionally usable manually operable valve to prevent or terminate fluid release even after the trigger members and release members have been actuated.

The device includes an electric safety alarm system to warn the user if any one of the trigger members has been actuated, intentionally or unintentionally, and the alarm system includes an optionally usable alarm cut-off switch. Provision is made to connect a substantially larger exteriorly located fluid supply container to the nozzle of the device.

This device, by a small modification of its nozzle and by providing a container of teargas or any other repelling agents to be worn on the forearm, will permit the wearer by simply bending his wrist so his hand would not be in the way of the spray, to straightly spray at the attacker. In this case instead of breaking the glass vial, a glass stopper is broken to allow the teargas to spray several feet from the nozzle. However, if the wearer chooses to prevent emptying the container completely, as in such a case as the attacher is waiting until the container is empty before attacking again, the wearer can do so by turning a manual valve that is located on the nozzle to shut it off. When the danger is approaching again the wearer can turn the valve on again and allow the chemical to spray the attacker.

Since the forearm is close to nine inches, is an area which does not have any joints, and does not bend, the size of the container can be anywhere from an inch to several inches according to the needs of the wearer. Of course, the container should be long and thin, so it can be worn under a jacket or shirt without discomfort and being obvious. The wearer can choose the size that fits personal needs. The skunk scent and spray can either be mixed in the spray container, which is probably a preferred way, or can be used as two separate containers in one device to both be released simultaneously.

An attack repellent device in accordance with the invention offers numerous advantages over the prior art. For example, being worn externally it is readily available for use. Various types of fluids and containers therefor can be employed. Provision of one or more trigger members which must first be released before the fluid release members can be actuated, and requiring simultaneous actuation of the fluid release members, inhibits accidental discharge of the fluid. Progressive actuation of the trigger members in the case of an apparently imminent attack enables the user to anticipate an attack and finally release the fluid even sooner than would otherwise be the case. Provision of an alarm system responsive to actuation of a trigger member also aids in inhibition of accidental discharge, and the alarm cut-off switch avoids emberrassment. Other objects and advantages will hereinafter appear.

DRAWINGS

FIG. 7 is a greatly enlarged schematic top plan view of the components within the housing of the device and showing the device fully disarmed and ready for use;

FIG. 11 is an electric circuit diagram of a safety alarm system in the device;

FIG. 12 is a view similar to FIG. 7 but showing all the components within the housing in fluid-release position;

FIG. 13 is an enlarged top plan view of one the combined latch and switch members shown in FIGS. 1, 2, 7 and 12;

FIG. 14 is a side view, partly in section, of one version of the member shown in FIG. 13;

FIG. 15 is a view similar to FIG. 14 of another version of the member shown in FIG. 13; and FIG. 16 is a perspective view of a larger container for attachment to the housing.

DESCRIPTION OF A PREFERRED EMBODIMENT

Figure 1:
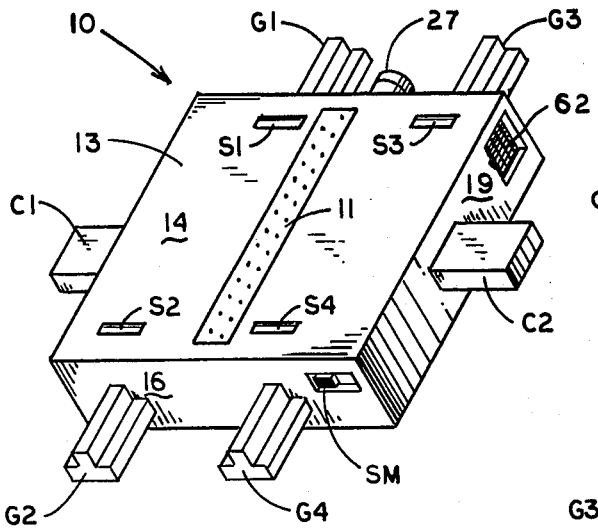
FIG. 1 is a top rear perspective view of one embodiment of an attack repelent device in accordance with the present invention, such embodiment taking the form of a device attachable to the wrist of a user by means of an expandable or releasable bracelet.
Figure 2:
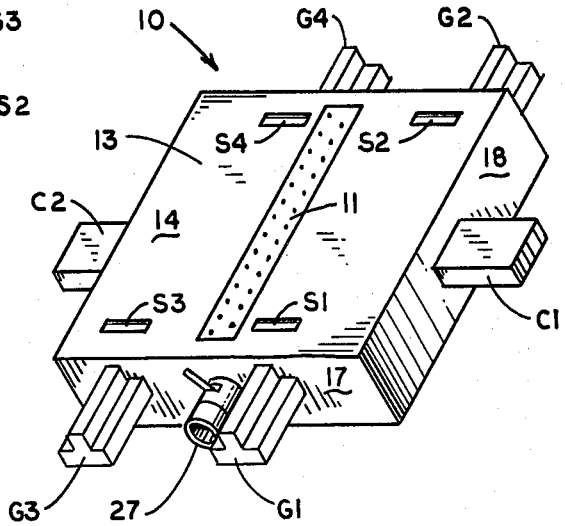
FIG. 2 is a top front perspective view of the device of FIG. 1.
Figure 3:
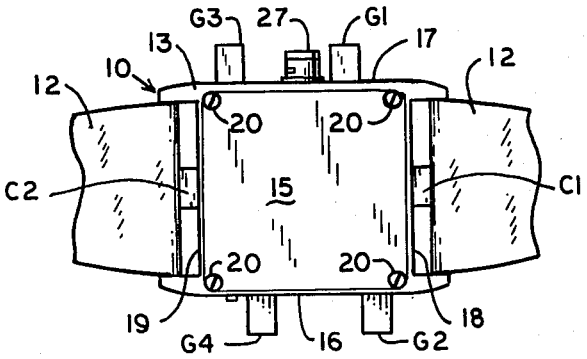
FIG. 3 is a plan view of the bottom of the device of FIGS. 1 and 2.

FIGS. 1, 2 and 3 show an attack repellent device 10 in accordance with the invention. Device 10, which in practice is about 4.5 cm long, 2.5 cm wide, and from 1 to 1.5 cm thick (or other preferred size), is attachable to the wrist or forearm of a user by means of a bracelet 12 (FIG. 3) which is strong and not easily broken or torn off by an attacker.

Figure 4:
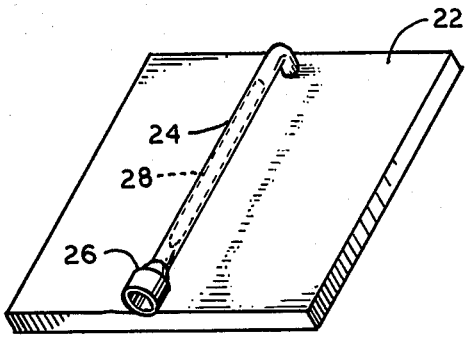
FIG. 4 is a top front perspective view of a replaceable fluid container for mounting within the device shown in FIGS. 1, 2 and 3.
Figure 5:
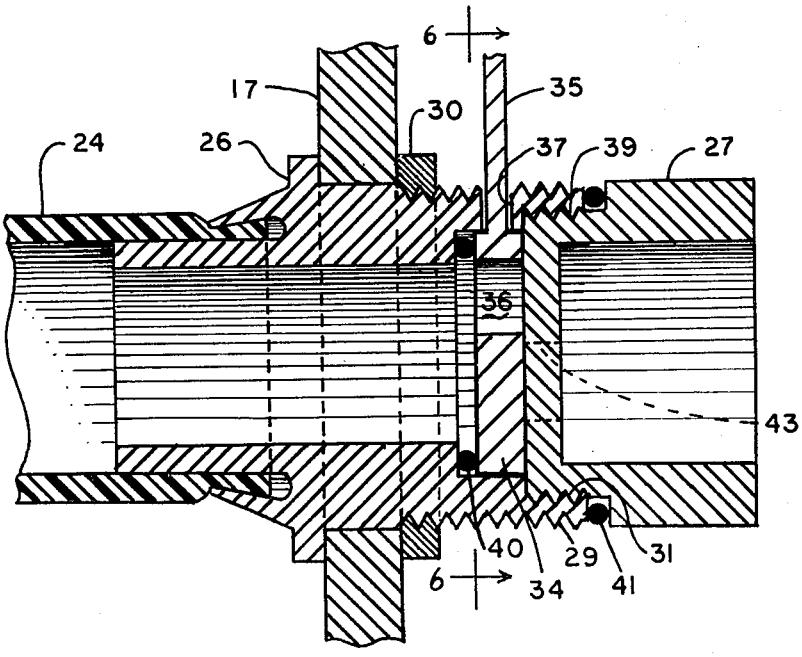
FIG. 5 is an enlarged cross-section view of the nozzle and valve of the device shown in FIGS. 1, 2 and 3.
Figure 6:
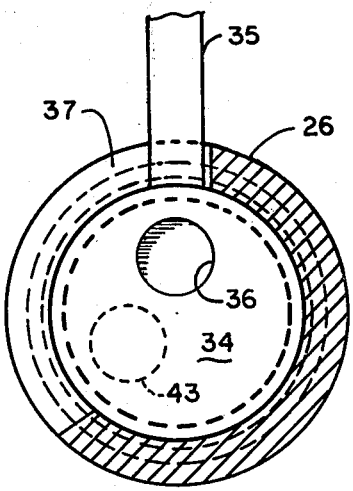
FIG. 6 is a cross-section view taken on line 6—6 of FIG. 5.

Device 10 generally comprises a housing 13, fabricated of metal or plastic, and having a top side 14, a bottom side 15, a front side 16, a rear side 17, and lateral sides 18 and 19. Bottom side 15, which takes the form of a cover held in place by four screws 20, is removable to allow a fluid container to be mounted within housing 13. The container, whatever its specific form, must include a portion which is breakable or piercable to allow escape of the fluid therein. A container in the form of a pressurized cannister 22 having a flexible tube 24 in which a frangible glass stopper 28 is disposed is shown in FIG. 4. Tube 24 terminates in a coupling 26 for attachment to a nozzle 27 on housing 13 through which fluid is sprayed. If preferred, a glass vial (not shown) containing a pressurized or unpressurized fluid could be employed instead of cannister 22 and could occupy the same position as tube 24, the fluid therein dispersing through the perforated area 11 on top side 14 of housing 13. Or, a relatively large pressurized fluid container 23, shown in FIG. 16, to be worn on the forearm of the user and having a tube similar to tube 24 and extending into housing 13 through the bottom, if cover 14 is removed, could be employed. In this case, the screws 20 through holes 23A in in the flanges 23B hold container 23 rigidly in place. The nozzle 27 includes an optionally usable manually operable valve 34 to prevent or terminate fluid release even after all six pushbutton members hereinafter described, are actuated. As FIGS. 5 and 6 show, coupling 26 has external threads 29 which engage threads in a nut 30 on wall 17 of housing 13. Coupling 26 also has internal threads 31 for engaging the external threads 39 on nozzle 27. Coupling 26 is provided with a valve 34 having a hole 36 therein which can be made to register with a hole 43 in nozzle 27 when the valve 34 is rotated by handle 35 which extends through a slot 27. O-rings 40 and 41 are provided for a fluid-tight seal.

Stopper 28 of container 22 is breakable by crushing between a pair of jaws J (see FIG. 12) which are mounted on movable plates D1 and D2 which are connected to manually actuatable fluid release members C1 and C2, respectively, which have pushbutton portions PB extending from the lateral sides 18 and 19, respectively, of housing 13. The members C1 and C2 can be depressed inwardly toward each other to effect breakage only if two conditions are met; first, all four manually actuatable resettable trigger members G1, G2, G3, G4 must be depressed, and second, the members C1 and C2 must be actuated simultaneously or in sequence with each other. The trigger members G1, G2, G3, G4 also also include pushbutton portions PB extending from the front side 16 and rear side 17 of housing 13.

As FIG. 11 shows, device 10 includes an electric safety alarm system to warn the user if any one of the trigger members G1, G2, G3, G4 has been actuated. The trigger members G1, G2, G3, G4 are arranged to operate normally open single pole single throw electric switches S1, S2, S3, S4, respectively, which are electrically connected in parallel with each other between one side of a battery B and one side of a transducer 64, through a main on-off single pole single throw cut-off slide switch SM. The other side of the battery B and transducer 64 are directly connected to each other. Transducer 64 drives a transformer 63 which in turn powers a small loudspeaker 60 which gives audible warning when switch SM is closed and any one of the switches S1, S2, S3, S4 is closed in response to depression of its associated trigger member G1, G2, G3, G4, respectively.

In practice, as FIGS. 13, and 14 show, a switch such as S1 can be combined with a detent assembly or latch which operates to releasably maintain the trigger member G1-G4 in depressed position after it has been actuated. The detent assembly includes an electrically conductive biasing spring 49 which has one end rigidly anchored to top side 14 of housing 13 in a slot 51 and which has a detent member 52 attached as by a screw 53 to its other end. Detent member 52 which is biased downwardly in a hole 55 in top side 14 engages a recess R in trigger member G1 when the latter is depressed and maintains the latter depressed. At the same time spring 49, which serves as a leaf-spring type movable contact for switch S1, engages stationary contact 54 which takes the form of a rivet in top side 14 of housing 13.

Device 10 has four members G1, G2, G3, G4 which prevent members C1 and C2 from being depressed accidentally. Members C1 and C2 cannot be depressed unless all four members G1-G4 are depressed first. If one trigger member is not pressed, the container seal 28 cannot be broken. This highly sophisticated safetly device 10 is designed so that the wearer will never suffer the social embarrassment of accidentally smelling of skunk odor or accidentally spraying someone. Besides this, even if any of the members G1-G4 are depressed, the alarm will warn the wearer of the potential danger, who will then be alerted, and will be able to return the trigger members to their out-of-use position. This is particularly helpful in such cases as car accidents, fist-fights, or sleeping while wearing the device 10, which make it at least possible for the device to go off accidentally.

As FIGS. 7 through 10 show, members G1-G4 are substantially identical to each other. Members G1-G3 are located in the upper part of the housing 13 and G2 are located in the bottom part of the housing. Members C1 and C2 are substantially identical to each other. Member C1 comprises a pushbutton portion PB, a blade portion N and lateral projections 01 and 02. Member C2 comprises a pushbutton portion PB, a blade portion N and lateral projections 03 and 04. Members C1 and C2 are connected at their inner ends to the plates D1 and D2 which are provided with jaws J, as hereinbefore mentioned. As FIGS. 7 and 10 best show, plate D1 includes projecting blades P3 and P4 which extend forwardly therefrom through holes 75 and 76 in plate D2. Similarly, plate D2 includes projecting blades P1 and P2 which extend forwardly therefrom through holes 77 and 79 in plate D1.

Each member G1-G4 comprises a pushbutton portion PB, a blade portion K having a detent-receiving notch or slot R therein on its top side, and end protrusions designated M1, M2, M3, M4, respectively.

The blade N of member C1 moves between the the portions M1 and M2 of G1 and G2, respectively, in the same manner as the blade N of member C2 moves between the portions M3 and M4 of members G3 and G4, respectively. Each member C1, C2, G1-G4 includes a pushbutton portion PB which is slidably supported in a sleeve L which is integrally formed in the walls of housing 13 of device 10. A biasing spring SP1 or SP2 is disposed within the portion PB to bias the member outwardly of the housing 13. Projections such as 78 are molded on the interior of housing 13 where appropriate to align and guide movable memers and support other members, as FIGS. 7, 8, 9 and 10 show.

Figure 8:
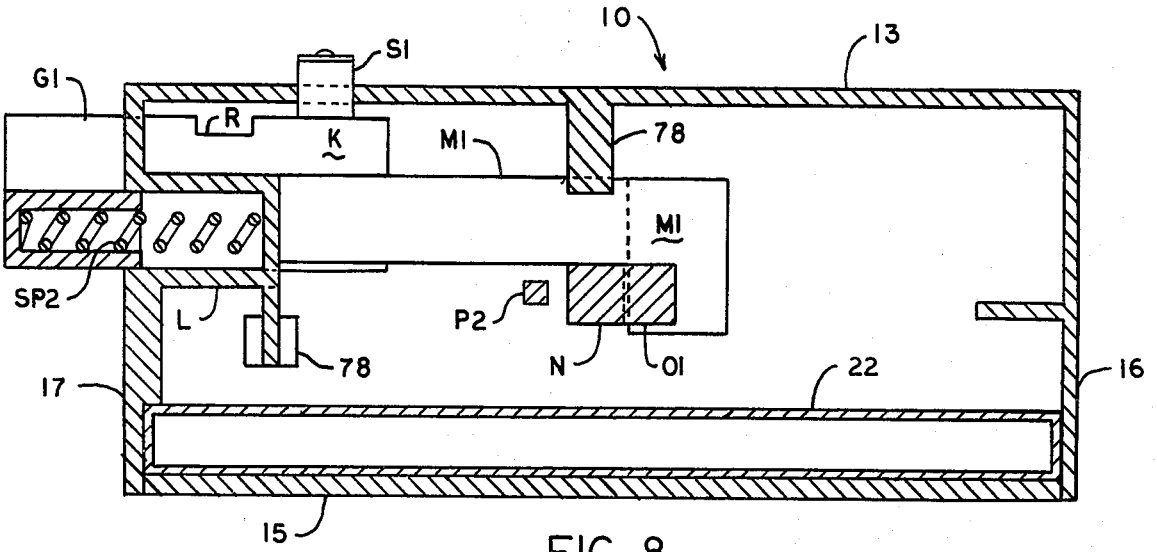
FIG. 8 is a cross-section view taken on line 8—8 of FIG. 7.
Figure 9:
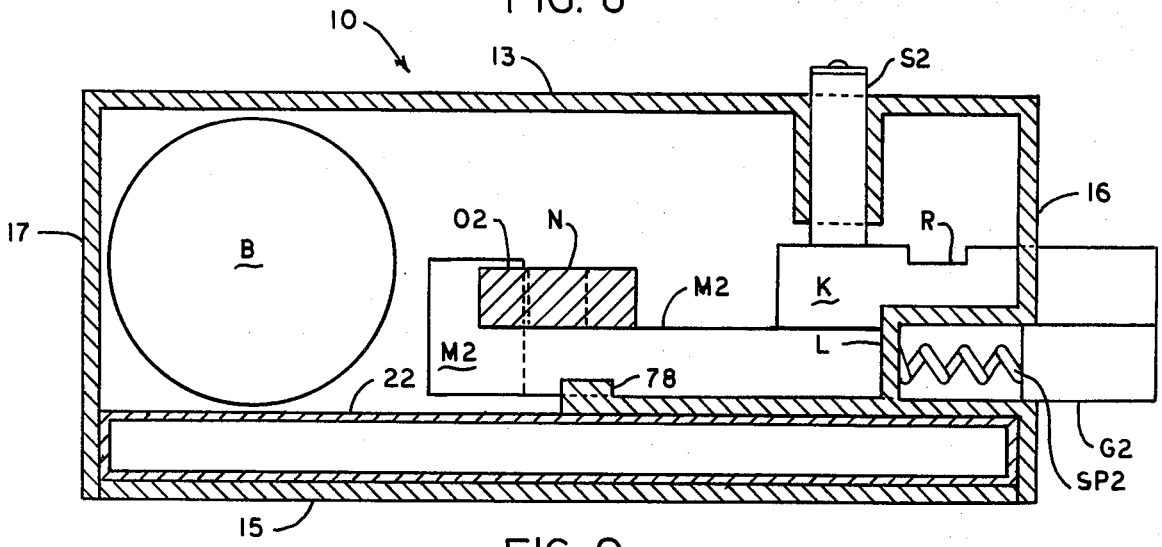
FIG. 9 is a cross-section view taken on line 9—9 of FIG. 7.
Figure 10:
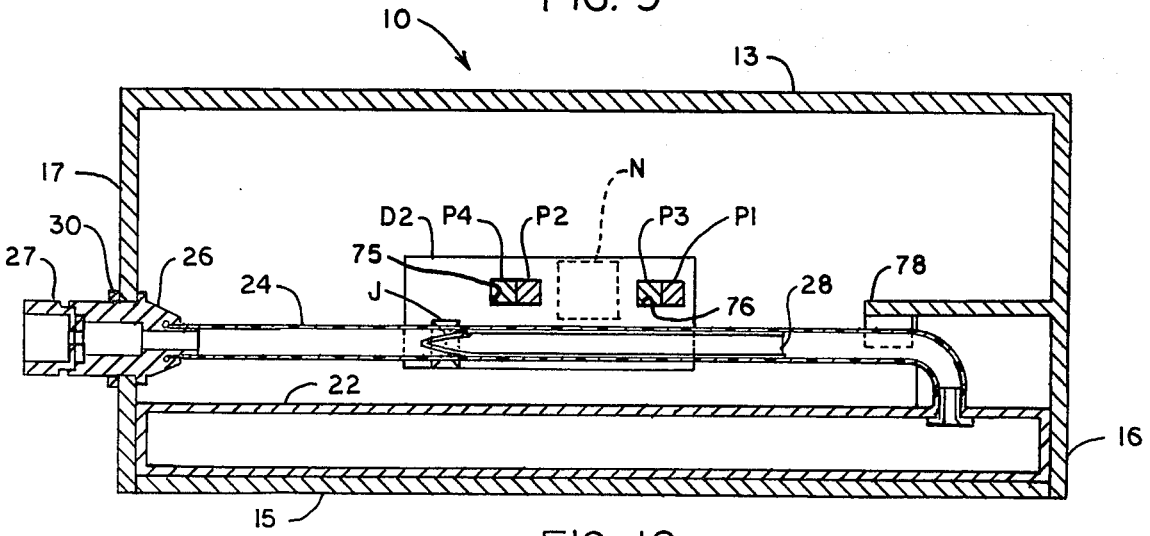
FIG. 10 is a cross-section view taken on line 10—10 of FIG. 7.

FIGS. 7, 8 and 9 show the members C1, C2, G1, G2, G3, G4 in non-actuated or non-depressed condition, whereas FIG. 12 shows all such members as actuated or depressed. As FIGS. 7 and 8 show, the downwardly extending protrusion M1 of non-depressed trigger member G1 interferes with projection 01 on member C1 thus preventing member C1 from being depressed. As FIGS. 7 and 9 show, the upwardly extending protrusion M2 of non-depressed trigger member G2 interferes with projection 02 on member C1 thus preventing member C1 from being depressed. It is to be understood, as shown in FIG. 7, that trigger members G3 and G4, if not depressed, prevent depression of member C2, since member M4 and projection 04 interfere with each other and member M3 and projection 03 interfere with each other. Thus, it is seen that if both members G1 and G2 are not depressed, member C1 cannot be depressed. If members G3 and G4 are not depressed, member C2 cannot be depressed.

If it is assumed that members G3 and G4 are depressed but G1 and G2 are not depressed, then member C2 still cannot be depressed, because blades P1 and P2 of member C2 will not allow member C2 to be depressed, because they bear against protrusion M1 and M2 of members G1 and G2, respectively. It is also apparent that if three trigger members are depressed and one is not, neither of the members C1 and C2 can be depressed, because blade P2 bears against protrusion M2 and prevents member C2 from moving and protrusion 02 bearing against M2 prevents member C1 from being depressed. This is a sophisticated system that makes it unlikely for the breakable container portion 28 to be broken unless all four members G1-G4 are depressed. In the same manner, blades P3 and P4 associated with member C1 bear against protrusions M3 and M4 and act in the same manner as described. When one of the trigger members, for example G1, is depressed it moves away from protrusion 01. When the rest of the members G2, G3, G4 are depressed, they move away from the protrusions 02, 03, 04 and also move away from blades P1, P2, P3, P4.

This allows members C1 and C2 to be pressed toward each other so that the jaws J can reach and act upon container stopper 38 and break it.

As previously explained, each one of the trigger members G1, G2, G3, G4 is provided with a latch member (combined with the electric switch). When the members G1-G4 are depressed they remain so by means of the detent members 52 or 52A that are biased downwardly by the steps 49. The detents enter in the notch R and remain so until the wearer lifts spring 49, as by means of a common pin (not shown) or knife-blade tip (not shown), to allow the pushbutton members to return to the unused position under the action of the springs SP2. Also, when a member G1-G4 is depressed, spring 49 makes contact with stationary terminal 54 and this causes the buzzer or audible warning device 60 to sound off and alert the wearer of the situation. Switch SM is used to turn off warning device 60 if the wearer desires.

In an embodiment of the invention wherein a breakable glass vial is used as the fluid container which is to be crushed between the jaws J, it is preferred that a cloth or plastic mesh cover (not shown) be provided therearound, so that pieces of broken glass do not spread around the interior of housing 13.

It will also be understood that components forming part of the audible alarm system could be located in places within housing 13 other than shown and that various commercially available electrically operated sounding devices could be employed instead of the speaker 60 which is shown. Furthermore, the switches S1-S4 could be independent components (i.e., independent of the latch members) and located in positions other than shown, as long as they respond to trigger member position.

I claim:

1. An attack repelling device to be worn by a user and comprising:

a housing;

a fluid container mounted on said housing and containing fluid; said fluid container comprising a breakable portion which, when broken, enables fluid to flow from said container;

fluid release means on said housing and actuatable by said user to break said portion of said fluid container;

and trigger means on said housing interengageably associated with said fluid release means and actuatable by said user prior to actuation of said fluid release means to enable actuation of said fluid release means, said fluid release means comprises a pair of movable fluid release members, wherein said trigger means comprises a pair of movable trigger members interengageably related with each of said fluid release members, and wherein said pair of fluid release members are interengageably related with each other whereby said breakable portion of said fluid container cannot be broken until all trigger members and both fluid release members are actuated.

2. A device according to claim 1 including means to releasably lock said trigger members in actuated position.

3. A device according to claim 1 including warning means responsive to position of said trigger members to indicate actuation thereof.

4. A device according to claim 3 wherein said warning means includes an electric battery, a warning device, and an electric switch operable by each trigger member when the latter is actuated to connect said warning device to said battery whereby a warning signal is provided to said user.

5. A device according to claim 4 further including a master switch on said devie and operable to disconnect said warning device from said battery to prevent operation of any of said electric switches from effecting a warning signal.

6. An attack repelling device to be worn by a user and comprising:

a housing;

a fluid container mounted on said housing and containing fluid;

said fluid container comprising a breakable portion which, when broken, enbles fluid to flow from said container;

a pair of movable fluid release members actuatable by said user to break said breakable portion of said container, said fluid release members being interengageably related to each other so that both must be actuated simultaneously;

a pair of movable trigger members interengageably related to each fluid release member so that each trigger member in the pair of trigger members must be actuated to enable actuation of their associated release member;

and means to releasably lock each trigger member in actuated position.

7. A device according to claim 6 including a nozzle on said housing and valve means on said nozzle operable by said user to prevent fluid flow from said container.

8. A device according to claim 7 including warning means responsive to actuation of a trigger member to provide a signal to the user indicative of such actuation.

9. A device according to claim 8 including means to shut off said signal from said warning means.

* * * * *